United States Patent [19]

Shepherd

[11] Patent Number: 4,868,956

[45] Date of Patent: Sep. 26, 1989

[54] FILL SLAT RETAINER CLIP

[76] Inventor: Charles E. Shepherd, 4202 Markham, Houston, Tex. 77027

[21] Appl. No.: 296,005

[22] Filed: Jan. 12, 1989

[51] Int. Cl.[4] ..... B01F 3/04; A44B 21/00

[52] U.S. Cl. ..... 24/336; 261/111

[58] Field of Search ..... 24/336, 335, 339, 326; 261/111, DIG. 11; 211/70.2

[56] References Cited

U.S. PATENT DOCUMENTS

| | | | |
|---|---|---|---|
| 1,466,873 | 9/1923 | Cates | 24/336 |
| 3,295,812 | 1/1967 | Schneider et al. | 24/339 |
| 3,389,895 | 6/1968 | De Flon | 261/111 |
| 4,326,653 | 4/1982 | Stone | 24/336 |
| 4,576,764 | 3/1986 | Shepherd et al. | 261/111 |
| 4,589,794 | 5/1986 | Sugiura et al. | 24/336 |
| 4,774,034 | 9/1988 | Fritz | 261/111 |

*Primary Examiner*—Victor N. Sakran

*Attorney, Agent, or Firm*—Foley & Lardner, Schwartz, Jeffery, Schwaab, Mack, Blumenthal & Evans

[57] ABSTRACT

A retainer clip for mounting and retaining fill slat on vertical and horizontal supporting wires in a water cooling tower, wherein the retaining clip is formed with a body portion and retaining flanges adapted to coact with the fill slat. The opposite end walls of the clip are each formed with a plurality of spaced projecting tabs and surrounding recesses, and a central outwardly exposed half groove. The projecting tabs at each end of the clip correspond in dimension and location to the recesses in the opposite end wall of the clip, and vice versa, whereby adjacently disposed and mirror image end walls of laterally adjacent clips can be engaged so that the projecting tabs of both end walls define essentially continuous side walls surrounding a full groove adapted to receive a vertical wire. The reduction in length permitted by the tab and recess mounting arrangement is such that clips can be laterally adjacently mounted thereby permitting the cooling tower to be more densely packed.

5 Claims, 2 Drawing Sheets

FILL SLAT RETAINER CLIP

BACKGROUND OF THE INVENTION

The present invention relates as indicated to a retainer clip for a fill slat, and more particularly a clip for retaining a fill slat in position in a cooling tower.

The use of fill slats or splash bars, as they are also commonly known, in cooling towers is common practice. The fill slats are positioned in the tower in vertically and normally laterally staggered positions to provide a meandering path for the water descending in the cooling tower. Water is thus diverted upon contact with a particular fill slat and directed laterally to contact a laterally adjacent, lower fill slat in the cooling tower. Where the fill slats are formed with perforations, the water descends directly through the fill slat to the fill slat positioned below. This continual breaking up of the water into droplets enhances vaporization and thus cooling of the water. Air is adapted to flow through the tower either transversely to the descent of the water (cross-flow type) or the air can travel upwardly in the direction opposite to the descent of the water (counter-flow type).

The fill slats are retained in the cooling tower on grids of mesh comprised of horizontal and vertical support wires spot welded or otherwise secured at the points of intersecting contact. The wire mesh thus defines a series of rectangular openings through which the fill slats extend for support by the horizontally extending wires.

The fill slats are normally made of plastics material of various types and are accordingly relatively light in weight, particularly if the contact surfaces are perforated. In view of the air flow conditions within the cooling tower, there is a tendency toward instability, and the fill slats can turn over as well as moving longitudinally in the air flow direction. Due to these destabilizing factors, it is known to use retaining clips of various sorts to retain the fill slats in their mounted position on the wire grids.

One such retainer is shown in applicant's prior U.S. Pat. No. 4,576,764, in which a holding clip is clamped to a downwardly extending flange of the fill slat so as to prevent both longitudinal and rolling or tilting movement of the fill slat relative to the support wires.

Another commercially known retainer clip comprises upper flanges which extend over the flanges of the fill slats, vertical slots formed in the ends of the retainer clip to receive the vertical wires, and resilient flanges extending downwardly from the body of the retainer clip for frictionally engaging the horizontal supporting wire. Although this clip has worked generally satisfactorily, the vertical grooves at either end of the clip are defined by continuous vertical side walls which extend on both sides of the adjacent vertical wire when the clip is positioned in place. This type of groove-defining wall construction results in the overall length of the retainer clip being greater than the distance between adjacent vertical wires, thereby precluding the placement of clips and thus fill slats in a side by side relationship. In certain situations, it is highly desirable for density purposes to put fill slats in every space, and the clip just described is incapable of accommodating this spacing arrangement.

SUMMARY OF THE INVENTION

With the above in mind, a principal object of the invention is to provide a new and improved retainer clip which is constructed and arranged so that laterally adjacently positioned clips can receive fill slats to provide a continuous side by side fill slat arrangement.

A further object of the invention is to provide a retainer clip which can accommodate virtually all four inch fill slats. This is particularly important in view of the numerous different types of fill slats available commercially having that rather standard width. An inventory of retainer clips specifically designed to accommodate a particular shape fill slat need not therefore be maintained.

The retainer clip of the present invention is also characterized by its inexpensive manufacturing cost. The clip can be integrally molded in a single piece from inexpensive and well known plastics materials. The highly desired objective of providing side by side fill slat mounting is achieved by the unique construction of the end walls of the retainer clip. Each end wall contains alternating projections and recesses so that when adjacent retainer clips are contiguously disposed, they can be interconnected by a tongue and groove arrangement. A part of the wire-receiving vertical groove is accommodated by each of the interconnected ends, thereby permitting substantial reduction of the overall length of the retainer clip. In this manner, each clip can be completely contained disposed between vertically extending wires and yet interconnected to adjacently disposed retainer clips to form a laterally continuous supporting system for receiving fill slats.

A still further object of the invention is to provide a retainer clip of the type described which is stable when exposed to environmental conditions within the cooling tower. It retains the fill clip from moving longitudinally in response to air flow, and the mounting of the clip on both the vertical and horizontal supporting wires prevents tipping of the clip and thus the fill slat. Moreover, the mounting is sufficiently rigid that vibration is minimized.

These and other objects of the invention will be apparent as the following description proceeds in particular reference to the application drawings.

DETAILED DESCRIPTION OF THE APPLICATION DRAWING

Figure 1:
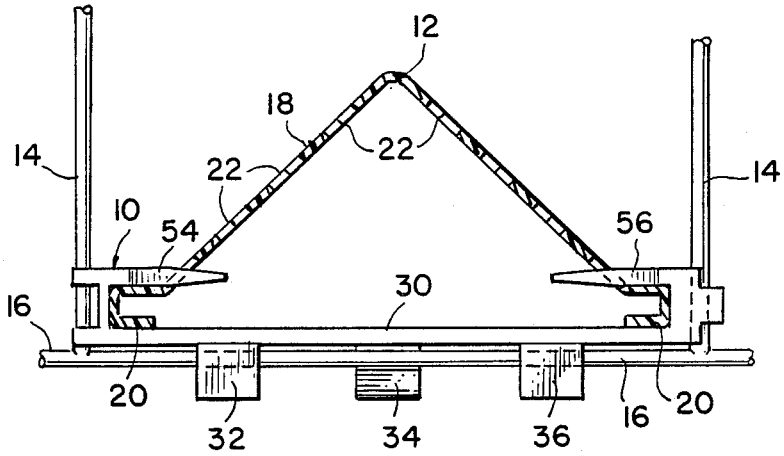
FIG. 1 is a side elevational view showing the retainer clip of the present invention mounting a fill slat on vertical and horizontal supporting wires.
Figure 2:
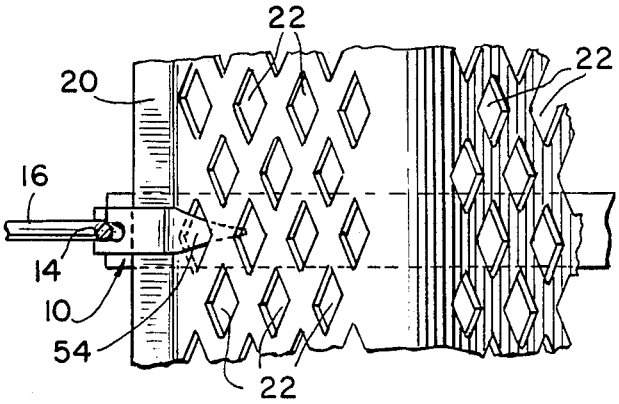
FIG. 2 is a fragmentary top plan view of FIG. 1, showing the manner in which the elongated end of the top retaining flange extends through a perforation the sidewall of the fill slat.
Figure 3:
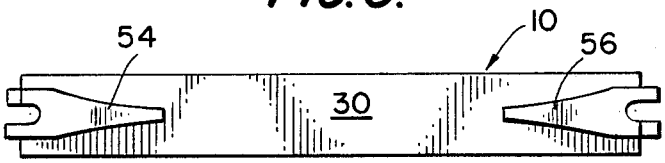
FIG. 3 is a top plan view of the retainer clip by itself.
Figure 4:
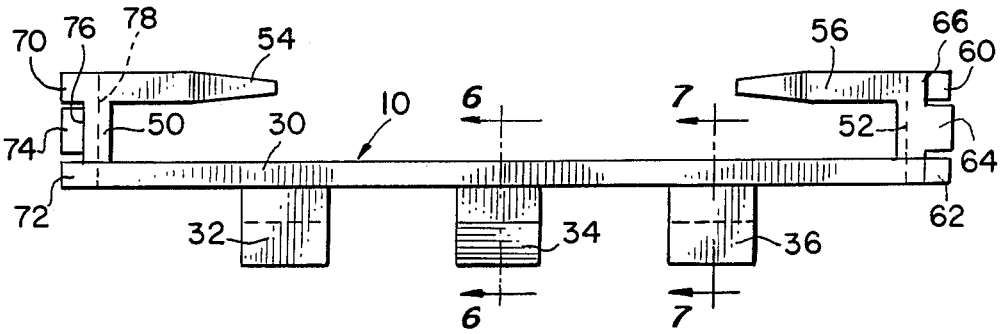
FIG. 4 is a front elevational view of the retainer clip.

Referring to the application drawings, in which like parts are indicated by like reference numerals, the retaining clip of the present invention is generally indicated at 10, and a single clip is shown in FIGS. 1 and 2 in which is mounted a fill slat 12. The fill slat is adapted to be supported by a wire grid system comprised of intersecting vertical wires commonly designated at 14, and horizontal wires 16. The wires are welded or otherwise secured at their points of intersection to form a grid hanger, with the wires being spaced approximately four inches apart. The wire grid is suspended vertically in the cooling tower, in a well known manner. Similar wire grids are laterally offset and likewise suspended vertically to support the fill slat at various locations.

In the form shown, the fill slat 12 is generally triangular shapes in cross section, including tapered side walls commonly designated at 18, each of which is formed at its bottom, free end with a lateral, reversely bent flange 20. The flange is positioned in and supported by the retaining clip. The overall width of the fill slat is such that it fits loosely within and between the vertical mounting wires which are four inches apart.

In the form shown, the side walls 18 of the fill slat 12 are formed with a series of continuous diamond shaped openings commonly designated at 22. As previously noted, water descending in the cooling tower will be reflected by the side walls 18 or pass partially or entirely through the openings 22. In either instance, droplets of water are formed which contact cooling air traveling through the tower thereby transferring heat from and consequently cooling the water. The fill slat 12 shown by way of example is illustrated in U.S. Pat. No. 3,389,895, as is the wire grid supporting system. The particular form of fill slat is not of critical importance to the present invention, and a significant advantage of the present invention is its adaptation to various types of four inch fill slat currently being used. However, the fill slat 12 illustrated does have the advantage of providing an opening adjacent the bottom flange on each side of the fill slat through which the elongated top flange of the retaining clip can extend for locking engagement. This will be explained in more detail below.

Only a single retainer clip is shown in FIG. 1 for sake of clarity. However, an important feature of the present invention is the ability to place retainer clips, and therefore fill slats, laterally side by side so as to maximize the fill slat density in the cooling tower. The end walls of each retainer clip 10 are uniquely constructed so as to interconnect with the ends of adjacently disposed clips to form a single groove for receiving the vertical wire, as will be presently described.

FIGS. 3–7 illustrate the retainer clip per se. The clip includes an elongated body portion 30 having integrally formed therewith downwardly depending wire-embracing legs 32, 34 and 36, which are spaced along the length of the body portion 30 and from the ends of the clip. The legs are identical in construction although mounted at different locations on the body relative to the longitudinal axis, and they vary in the direction in which they face. The legs 32 and 36 (see FIG. 7) are identical in orientation and direction, with each including a bottom shoulder 38, the top surface of which is adapted to engage the bottom of the horizontal supporting wire so as to frictionally retain the retainer clip on the wire. The center leg 34 (see FIG. 6) faces in the opposite direction and is positioned on the opposite side of the longitudinal axis of the body portion 30. The leg 34 is likewise formed with a shoulder 40.

Figure 5:
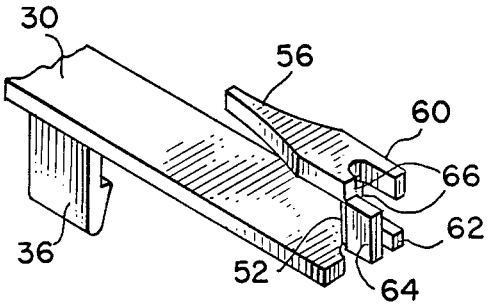
FIG. 5 is a fragmentary end perspective view of the retainer clip.
Figure 6:
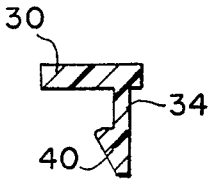
FIG. 6 is a sectional view taken on line 6—6 of FIG. 4.
Figure 7:
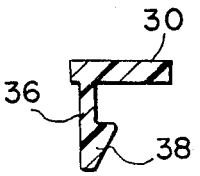
FIG. 7 is a sectional view taken on line 7—7 of FIG. 4.

FIG. 5 illustrates the lateral offset of the center leg 34 from the end legs 32 and 36 (which are aligned), and also shows the overlap of the shoulders 38 and 40. Due to the resilience of the preferred plastic material from which the retainer clips are molded, the horizontal supporting wire 16 can be forced into the area defined by the spaced and laterally offset legs, with the inclined or tapered surfaces of the shoulders 38 and 40 providing a ramp surface by means of which the legs can be moved laterally by the wire until the latter snaps into the opening defined by the spaced legs. When in such opening, the resiliently bent legs return to their normal position as shown in FIGS. 6 and 7, and the wire is therefore frictionally engaged by the legs. The ability to quickly snap the legs around the wire and thereby support the retainer clip on the wire greatly facilitates installation of the clip.

The clip further includes vertically extending end walls 50 and 52 each of which has integrally formed therewith a reversely bent tongue 54 and 56, respectively, which function to engage openings in the fill slat to retain the fill slat in place. Referring to FIG. 2, the tongue 54 will be seen extending through the adjacent opening 22 in the side wall of the fill slat. The tongues 54 and 56 can be of a length and shape to accommodate the specific configuration of the fill slat with which the clip is to be used. It is preferred that some degree of interlocking be achieved between the tongues and the fill slat in order provide a stable mounting. The tongues prevent longitudinal movement of the fill slat, and, together with the legs 32–36 of the clip, serve to prevent turning of the fill slat from its mounted position. Vibration is also minimized.

Each end wall 50 and 52 is formed with a series of spaced projecting tabs and alternating recesses which collectively define male and female receiving ends of the clip. These ends are essentially mirror images of each other and function, when male and female ends are adjacently positioned, to interlock to define a single, substantially continuous vertical wire-receiving groove, circular or elliptical in shape and of a dimension to receive the vertical wire.

Referring to FIG. 5, projecting tabs 60 and 62 project rearwardly at one side of the end wall, and a projecting tab 64 extends rearwardly at the opposite side of the end wall. These tabs are also visible in FIG. 4. Recesses commonly designated at 66 are formed above and below the projecting tab 64 and between the tabs 60 and 62, to receive projecting tabs formed on the end wall of the adjacently disposed clip. A generally semicircular groove 68 is defined between the projecting tabs 60–64, with the groove extending vertically throughout the height of the end wall.

The opposite end wall of the retainer clip is similarly formed, but a mirror image of the wall just described. Thus, referring to FIG. 4, the end wall 50 is formed with projecting tabs 70 and 72 at one side of the end wall, and a projecting tab 74 at the opposite side of the end wall. These projecting tabs 70–74 coincide in shape and location to the openings 66 provided between tabs in the opposite end wall of the clip. Recesses 76 similar to recesses 66 are formed in the end wall 52, shaped and located to correspond to the tabs 60–64 at the opposite end wall of the clip. The dashed line 78 extending vertically through the end wall 50 represents the bottom of the semicircular groove formed in the end portion, similar in shape and depth to the semicircular groove 68 formed in the opposite end wall.

Figure 8:
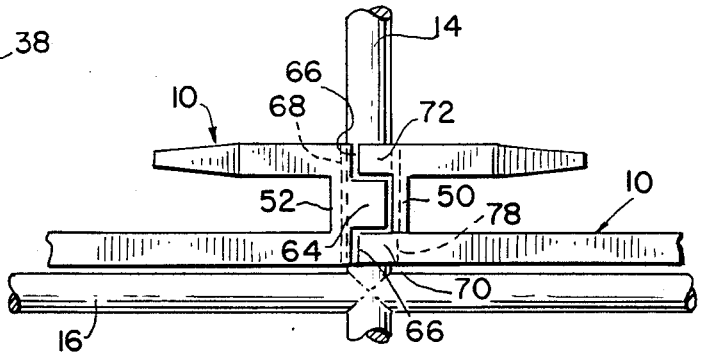
FIG. 8 is a fragmentary front elevational view showing adjacent retainer clips interconnected to jointly receive a vertical support wire thereby permitting fill slats to be positioned in side by side orientation. For sake of clarity, the fill slats are not shown in this figure.

FIG. 8 illustrates, in an enlarged view, the manner in which the respective end portions of adjacently disposed retainer clips are interconnected to receive the vertical wire 14. The clip 10 shown at the left in FIG. 8 corresponds to the right end of the clip shown in FIG. 4, and the clip 10 shown at the right in FIG. 8 corresponds to the opposite end of an adjacently disposed clip, similar in configuration to the end wall and tab construction shown at the left in FIG. 4. The projecting tabs 60, 62 and 64 engage recesses 76 formed in the end wall 50, and projecting tabs 70, 72 and 74 extend into recesses 66 provided therefor in the end wall 52 shown in FIG. 5. When so interconnected, the grooves formed in the end walls, the closed ends of which are illustrated at 68 and 78, define a circular or elliptical groove slightly greater in dimension than the diameter of the wire 14 so that the wire can be loosely accommodated in the circular groove.

It will further be noted in FIG. 8 that the projecting and interlocked tabs 64, 70 and 72 provide a tongue and groove arrangement that results in a substantially continuous side wall being formed on either side of the wire. The projecting tabs and recesses are dimensioned so that the tongue and groove connection can be made without difficulty but at the same time a firm connection is made between the adjacently disposed retainer clips. This is important to prevent shifting of the clip on the wire and to prevent disengagement of the clip ends.

By in effect taking up half of the vertical groove depth in each of the wall ends of adjacent clips, the clips can be disposed side by side in the manner shown in FIG. 8. This permits fill slat to be likewise mounted side by side, an important consideration in certain use environments. This is contrasted with known clip construction wherein each end of each retainer clip was formed with spaced continuous side walls which defined therebetween a full groove having a depth substantially more than the diameter of the vertical wire to be positioned therein. Although this provided a stable mounting of the clip on the vertical wire, it resulted in the overall length of the retainer clip being in excess of four inches whereby clips could not be positioned side by side. Thus, clips of this kind could only be used in environments where the positioning of fill slat in alternate rows was satisfactory. The retainer clip of the present invention uniquely provides the advantages of a continuous groove, but by an arrangement which permits side by side mounting as shown in FIG. 8.

The retainer clip described can be formed of any suitable plastics material having a degree of resilience, moldability, and the capability of being manufactured at relatively low cost. Polypropylene has proved highly satisfactory, although polypropylene copolymers and polyethylene block copolymers could also be used. The specific material employed is not critical to the utilization of the invention concepts as long as the material meets the criteria indicated.

The manner in which the present invention is used should be apparent from the above description and the accompanying drawings. The clips can be mounted on each grid by snapping the legs of each clip around the horizontal wire and by interengaging the projecting tabs of adjacently disposed clip ends around a vertical wire. The fill slat can be positioned in the clip either before the mounting of the clip on the wire, or afterwards. The latter is accommodated due to the fact that the fill slat is commonly produced from a resilient plastic material so that the side flanges can be slightly compressed to reduce the width of the slat, and later released so that the flanges 20 of the fill slat extend into the grooves defined by the body portion 30, the end wall 50 or 52, and the tongue 54 or 56 of each clip. As described, each tongue is elongated so that when the clip is used with fill slat of the type shown in FIG. 2, the tongue can extend through an adjacent opening to further secure and stabilize the fill slat on the clip.

It will be understood that changes in the retainer clip construction illustrated and described may suggest themselves to one skilled in the art without, however, departing from the concepts of the invention and the scope of the invention as defined in the appended claims. For example, the configuration of the tongues and the height of the end walls of the clip can be modified to adapt the clip for a specifically constructed fill slat. Equivalent forms for frictionally retaining the clip on the horizontal wire could also be utilized. Also, the half groove formed in each end wall could be rectangular rather than semicircular or semielliptical. The important consideration is that the clip be firmly mounted on the horizontal wire and guided on the vertical wires, and be of a dimension in length such that adjacently disposed clips can be interlocked to receive fill slat in a laterally continuous arrangement.

What is claimed:

1. A retainer clip for mounting and retaining fill slat on vertical and horizontal supporting wires mounted in a water cooling tower, said clip comprising:

(a) an elongated body portion adapted to extend substantially between vertical wires, and means for mounting said body portion on a horizontal wire;

(b) end walls at each end of said body portion, said end walls having integrally formed reversely bent tongue members at the upper ends thereof, said tongue members being adapted to coact with fill slat to retain the same on said clip;

(c) said end walls being further formed with a plurality of spaced, outwardly projecting tabs and surrounding recesses, the projecting tabs formed at each end corresponding in dimension and location to the dimension and location of the recesses formed at the other end;

(d) each of said end walls additionally defining a vertically extending half groove positioned generally centrally in said end wall between said tabs, whereby laterally adjacent first and second clips can be positioned so that the projecting tabs at one end of said first clip engage the recesses in the opposite end of the adjacently disposed second clip, and vice versa, whereby said half grooves are aligned to form a full groove to receive a vertical wire.

2. The retainer clip of claim 1 wherein said reversely bent tongue members are relatively elongated and generally pointed at the outer ends thereof, said pointed ends facilitating the insertion thereof through adjacent openings formed in the fill slat to be retained, thereby preventing longitudinal and rotational movement of said fill slat.

3. The retainer clip of claim 1 wherein said means for mounting said body portion on a horizontal wire comprises a plurality of downwardly depending longitudinally spaced legs, each leg having a shoulder partially defined by an inclined surface, said legs being positioned on both sides of the longitudinal central axis of said body portion, whereby the horizontal wire can be snapped into a spaced defined between said laterally spaced legs thereby to frictionally retain said clip on said wire.

4. The retainer clip of claim 1 wherein said clip is integrally molded of plastic material.

5. The retainer clip of claim 4 wherein said plastic material is selected from the group comprising polypropylene, polypropylene copolymers, and polyethylene block copolymers.

* * * * *